US005098095A

United States Patent [19]

Weiss

[11] Patent Number: 5,098,095

[45] Date of Patent: Mar. 24, 1992

[54] PUMP BALL

[75] Inventor: John S. Weiss, New York, N.Y.

[73] Assignee: Weiss Twice Toys, Inc., New York, N.Y.

[21] Appl. No.: 695,736

[22] Filed: May 6, 1991

[51] Int. Cl.[5] ..... A63B 37/00

[52] U.S. Cl. ..... 273/58 B; 446/220; 446/224

[58] Field of Search ..... 446/224, 220; 273/58 R, 273/58 B, 58 C, 58 BA, 58 J, 61 D, 65 R

[56] References Cited

U.S. PATENT DOCUMENTS 2,698,028 12/1954 Lee et al. ..... 446/224 X
3,020,673 2/1962 Cooke ..... 446/224
3,119,617 1/1964 Topper ..... 273/58 B
4,693,696 9/1987 Buck ..... 446/224

*Primary Examiner*—Mickey Yu
*Attorney, Agent, or Firm*—Bryan, Levitin, Franzino & Rosenberg

[57] ABSTRACT

An inflatable ball having a flexible wall defining an enclosure which can be thrown when inflated. A manually operated pump positioned on one side of the enclosure has an actuator which is contiguous with the flexible wall. The actuator can be pressed to inflate the enclosure. A release valve is positioned on an opposite side form the pump to balance the weight of the pump and provide for a manual release of air from inside the enclosure.

4 Claims, 1 Drawing Sheet

PUMP BALL

FIELD AND BACKGROUND OF THE INVENTION

The present invention relates in general to inflated throwing toys, and in particular to a new and useful throwing toy which incorporates a pump.

A ball is known from U.S. Pat. No. 1,683,910, which contains a pumping mechanism for making a sound. The pumping mechanism is incorporated in this ball and reacts to pressure on a string connected between the hand of a person playing with the ball, and the ball itself. U.S. Pat. No. 3,119,617 discloses another self inflating ball which incorporates a pumping mechanism that reacts when the ball is struck against the ground to keep the ball inflated as it is bounced. The pumping mechanism in this patent extends from one end of the ball to the other and represents a large heavy internal structure which would effect the trajectory of the ball when the ball is thrown.

A self inflating cushion containing a pumping mechanism is disclosed in U.S. Pat. No. 2,698,028. An inflatable mattress containing a pump is disclosed in U.S. Pat. No. 2,068,134. An inflatable chair with a pump incorporated therein is disclosed in U.S. Pat. No. 2,437,602. A tire with inflating mechanism is also disclosed in U.S. Pat. No. 643,017.

A throwing toy which has an internal pumping mechanism and which minimally effects the throwing characteristics of the toy would represent an advancement in this field.

SUMMARY OF THE INVENTION

An object of the present invention is to provide a ball which includes an internal pumping mechanism which can be manipulated by a person to initially inflate the throwing toy in preparation for use. The internal pumping mechanisms of the present invention is balanced and relatively light to minimize its effect on the throwing characteristics of the toy. The mechanism is also robust to resist damage when the ball is bounced.

Accordingly, an object of the present invention is to provide an inflatable throw toy comprising: a flexible wall defining an enclosure adapted to be thrown when inflated; and manually operated inflation means in said enclosure and having an actuator at least partly contiguous with said wall for inflating said enclosure when said actuator is pressed.

A still further object of the present invention is to position a deflation valve opposite from the inflation means in the ball to balance the weight of the inflation means to avoid erratic flight when the toy is thrown.

Although a preferred embodiment of the invention is a spherical ball, the throw toy may be oblong such as a football, flat or disc shaped like a bulbous throwing disc, or any other inflatable shape adapted for throwing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
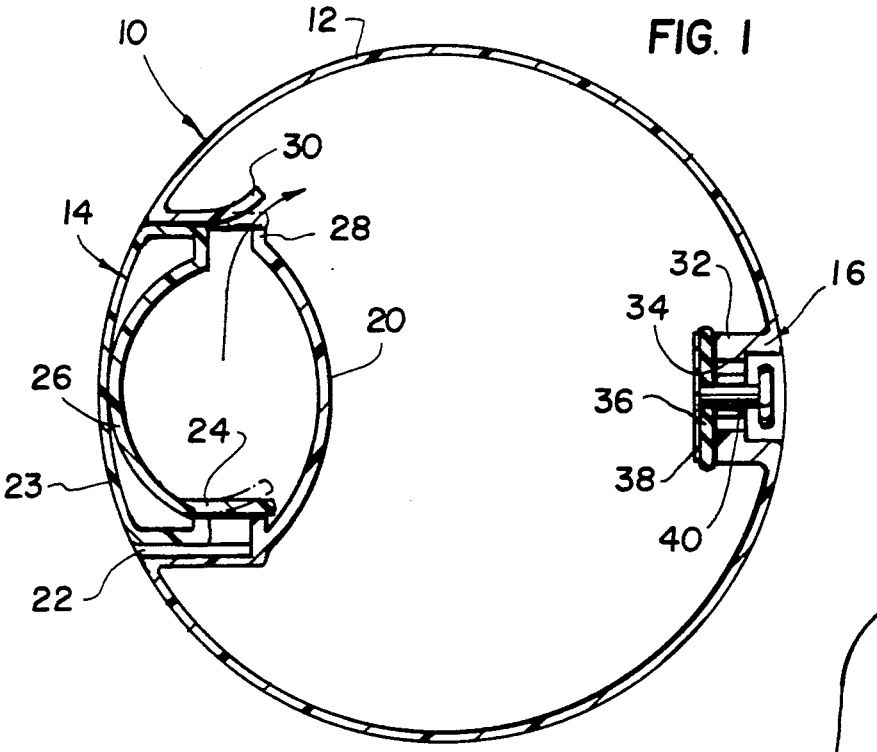
FIG. 1 is a sectional view of the throw toy in its inflated condition.
Figure 2:
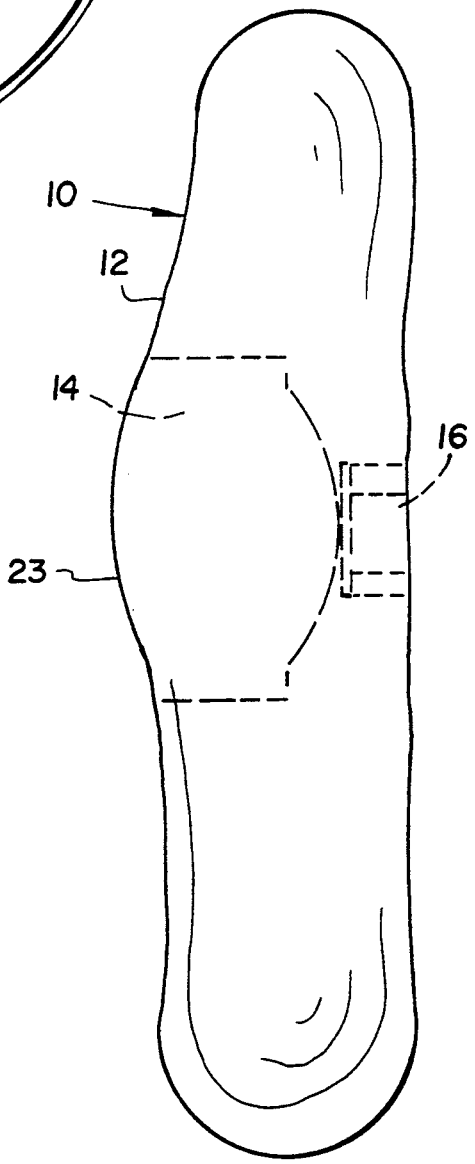
FIG. 2 is a side elevational view of the throw toy in a deflated condition.

Referring to the drawings in particular, the invention embodied in FIGS. 1 and 2 comprises an inflatable throw toy generally designated 10 and having a flexible wall 12 of plastic, rubber or other resilient synthetic material, which defines an enclosure which is hermetically sealed and adapted to be inflated so that the toy can be thrown. A manually operated inflation means 14 is mounted in the enclosure and on one side of the wall 12. Inflation means 14 has an outer actuator 23 which is contiguous with the outer surface of the wall 12 so that it is virtually undetectable when the ball is inflated for use. Dome-shaped actuator 23 which in the embodiment of FIG. 1 forms part of the spherical outer surface of a spherical ball forming the throw toy 10, is mounted in a housing 20 which is made of plastic or other material that is somewhat more rigid than the actuator 23 and the flexible wall 12. Actuator 23, has a curvature that matches that of the spherical ball as shown in FIG. 1. Housing 20 defines an interior space which is closed by a plunger 26 which is in the form of a partial sphere having a diameter smaller than the flexible wall 12. An inlet opening 22 which is relatively small with respect to the area of actuator 23, opens into the space defined inside the housing 20. A resilient flap 24 which is bendable into the housing space in the direction of the phantom line, forms an inlet one-way valve which moves to allow air to move into the housing 20 through the opening 22 when plunger 26 is released and, through its own resiliency, moves into the outer position for plunger 26 shown in FIG. 1. When actuator 23 is depressed, thus, pressing plunger 26 inwardly, valve 24 closes and a resilient flat 30 covering an outlet 28 from housing 20 is moved. Outlet 28 with its valve 30 forms an outlet one-way valve from housing 20 into the interior space of flexible wall 12. By depressing plunger 26 multiple times, the throw toy 10 is inflated to any desired extent.

In order to release the air from inside flexible wall 12, deflation means 16 having a release valve member 40 is actuated. Deflation means 16 comprises a somewhat rigid cylindrical support 32 made as one piece with or as a separate piece from the flexible wall 12 but hermetically sealed to the flexible wall. A flat inner wall of cylindrical support 32 carries a plurality of circumferentially disposed release holes 34 which, in the closed position for deflation means 16, are covered by a resilient closing disk 36. Release valve member 40 which may be made of rigid synthetic material has a rear support disk 38 which, due to the internal pressure in valve 12, presses closing disk 36 against the base of cylindrical support 32 thus sealing the release holes 34. A spring (not shown) may also be used to keep deflation means 16 closed.

A deflated condition for the throw toy 10 is shown in FIG. 2. In this condition, the somewhat rigid inner portion of housing 20 can be pushed up into engagement with the support disk 38 which, in turn, is supported by relatively stiff cylindrical support 32. A person using the toy places his or her hand across the side of the ball carrying the deflation means 16 and uses a finger or thumb of the other hand to press the actuator 23. Since the actuator 23 is braced against the opposite side of the toy through the housing of the inflation means and the cylindrical support of the deflation means, inflation of the toy is made easier. As the toy expands, actuator 23 can be pressed against the internal air pressure building within the flexible wall 12 until the toy is fully inflated as shown in FIG. 1.

While a specific embodiment of the invention has been shown and described in detail to illustrate the application of the principles of the invention, it will be understood that the invention may be embodied otherwise without departing from such principles.

What is claimed is:

1. An inflatable throw toy comprising:

a flexible wall defining an enclosure which is spherical and adapted to be thrown when inflated;

manually operated inflation means in and on one side only of said enclosure, said inflation means having an actuator contiguous with said wall for inflating said enclosure when said actuator is pressed, said actuator having a dome shape with a curvature which matches the spherical flexible wall when the enclosure is inflated, said inflation means comprising a housing defining an interior space, said actuator closing said interior space, an inlet one-way valve connected to said housing for only admitting air into said space from outside the wall when said actuator is released and an outlet one-way valve for discharging air from said space and into said enclosure when said actuator is depressed; and deflation means which is manually operated to deflate the enclosure, connected to the flexible wall and positioned in the enclosure on an opposite side of the flexible wall from said manually operated inflation means, said inflation means being spaced away from said deflation means when said enclosure is inflated to counter balance said deflation means.

2. A toy according to claim 1, wherein said deflation means comprises a cylindrical support positioned opposite to said housing on said flexible wall, said housing being engageable with said cylindrical support when beginning an inflation of the toy.

3. A toy according to claim 2, including a plunger connected to said housing and covered by said actuator.

4. A toy according to claim 3, wherein said deflation means comprise said cylindrical support having at least one hole therein, a closing disk engageable over the hole in said cylindrical support for sealing said s enclosure, and a release valve member connected to said closing disk for moving said closing disk away from the hole of said cylindrical support for releasing air from said enclosure.

* * * * *